US011840789B2

(12) United States Patent
Park et al.

(10) Patent No.: US 11,840,789 B2
(45) Date of Patent: Dec. 12, 2023

(54) WASHING MACHINE AND CONTROL METHOD OF WASHING MACHINE

(71) Applicant: LG Electronics Inc., Seoul (KR)

(72) Inventors: Seulgi Park, Seoul (KR); Woore Kim, Seoul (KR); Sangwook Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/870,275

(22) Filed: Jul. 21, 2022

(65) Prior Publication Data

US 2022/0356626 A1 Nov. 10, 2022

Related U.S. Application Data

(63) Continuation of application No. 16/283,120, filed on Feb. 22, 2019, now Pat. No. 11,427,947.

(30) Foreign Application Priority Data

Feb. 23, 2018 (KR) ..... 10-2018-0022106

(51) Int. Cl.
*D06F 34/26* (2020.01)
*D06F 21/04* (2006.01)
(Continued)

(52) U.S. Cl.
CPC ..... *D06F 34/26* (2020.02); *D06F 21/04* (2013.01); *D06F 37/04* (2013.01); *D06F 39/04* (2013.01);
(Continued)

(58) Field of Classification Search
CPC ..... D06F 39/04; D06F 58/26; D06F 2103/52
See application file for complete search history.

(56) References Cited

U.S. PATENT DOCUMENTS 3,268,082 A 8/1966 Robert
4,870,988 A 10/1989 Hood et al.
(Continued)

FOREIGN PATENT DOCUMENTS

CN 1075993 9/1993
CN 1611660 5/2005
(Continued)

OTHER PUBLICATIONS

Office Action in Chinese Appln. No. 202210220365.X, dated Apr. 19, 2023, 20 pages(with English translation).
(Continued)

*Primary Examiner* — Spencer E. Bell
(74) *Attorney, Agent, or Firm* — Fish & Richardson P.C.

(57) ABSTRACT

A washing machine includes: a tub; a drum of metal material configured to be rotated in the tub; an induction heater configured to be fixed to the tub in a state of being separated from the drum, and to heat the drum; a first temperature sensor configured to have a tube of metal material heated by the induction heater and a thermistor disposed in the tube, at least a part of the tube being exposed between the tub and the drum; a second temperature sensor configured to be disposed in a position further away than the first temperature sensor from the induction heater in a circumferential direction, and detect a temperature of air between the tub and the drum; and a controller configured to control the induction heater based on a first detection value of the first temperature sensor and a second detection value of the second temperature sensor.

16 Claims, 7 Drawing Sheets

(51) Int. Cl.

| | |
|---|---|
| ***D06F 37/04*** | (2006.01) |
| ***D06F 39/04*** | (2006.01) |
| ***D06F 58/26*** | (2006.01) |
| ***D06F 39/08*** | (2006.01) |
| ***D06F 25/00*** | (2006.01) |
| ***D06F 37/42*** | (2006.01) |
| ***D06F 105/28*** | (2020.01) |
| ***D06F 103/52*** | (2020.01) |
| ***D06F 103/32*** | (2020.01) |
| ***D06F 105/20*** | (2020.01) |
| ***D06F 58/50*** | (2020.01) |

(52) U.S. Cl.

CPC ..... *D06F 58/26* (2013.01); *D06F 58/50* (2020.02); *D06F 25/00* (2013.01); *D06F 37/42* (2013.01); *D06F 39/088* (2013.01); *D06F 2103/32* (2020.02); *D06F 2103/52* (2020.02); *D06F 2105/20* (2020.02); *D06F 2105/28* (2020.02)

(56) References Cited

U.S. PATENT DOCUMENTS

| | | | |
|---|---|---|---|
| 5,388,178 | A | 2/1995 | Moon |
| 9,765,470 | B1 | 9/2017 | Dufresne |
| 2006/0289455 | A1 | 12/2006 | Nakamura et al. |
| 2007/0220683 | A1 | 9/2007 | Kim |
| 2010/0058815 | A1 | 3/2010 | Lim et al. |
| 2015/0059200 | A1 | 3/2015 | Prajescu et al. |

FOREIGN PATENT DOCUMENTS

| | | |
|---|---|---|
| CN | 1721616 | 1/2006 |
| CN | 101008144 | 8/2007 |
| CN | 101410565 | 4/2009 |
| CN | 101575796 | 11/2009 |
| CN | 105350272 | 2/2016 |
| CN | 106012411 | 10/2016 |
| DE | 102016110883 | 11/2017 |
| EP | 0044040 | 1/1982 |
| EP | 2400052 | 12/2011 |
| EP | 3246451 | 11/2017 |
| JP | 2003-260290 | 9/2003 |
| JP | 2004-135998 | 5/2004 |
| WO | WO 2007138019 | 12/2007 |

OTHER PUBLICATIONS

Office Action in Korean Appln. No. 10-2023-0051289, dated Sep. 18, 2023, 10 pages (with English translation).

WASHING MACHINE AND CONTROL METHOD OF WASHING MACHINE

CROSS-REFERENCE TO RELATED APPLICATION

This application is a continuation of U.S. application Ser. No. 16/283,120, filed on Feb. 22, 2019, which claims the priority benefit of Korean Patent Application No. 10-2018-0022106, filed on Feb. 23, 2018. The disclosures of the prior applications are incorporated by reference in their entirety.

TECHNICAL FIELD

The present disclosure relates to a washing machine having an induction heater and a control method thereof.

BACKGROUND

Generally, in a washing machine, a drum accommodating laundry is rotatably provided in a tub for providing a space for containing water. Through holes are formed in the drum, water in the tub flows into the drum, and the laundry is moved by the rotation of the drum to remove contamination.

Such a washing machine may be provided with a heater for heating the water in the tub. The heater is, generally, operated in a state of being submerged inside the tub, and directly heats the water. However, in this case, since the heater should be operated in a state of being always submerged in the water for safety reasons, the heater may be used for heating the water in the tub. However, it is not suitable for heating the air in the drum in the state where there is no water in the tub, or for heating wet laundry before dewatering As a washing machine which directly heats a drum in contact with laundry, JP2004135998A discloses a washing drying machine (or a washing machine having a drying function) provided with a non-contact type heating device using microwave, electromagnetic induction, infrared rays, and the like. The washing drying machine includes a temperature sensor for detecting the temperature of the drum. Since the temperature sensor detects the temperature of the drum which is a rotating body, it is implemented of a non-contact type that can estimate the temperature without contacting the drum. However, the specific configuration of the temperature sensor is not disclosed in JP2004135998A.

EP2400052A1 discloses a washing machine in which a drum is heated by an induction heating system. In this washing machine, a heat sensor is disposed between the drum and a tank (or the tub) to detect the temperature of water or the temperature of air in the tank. In this system, the temperature of the drum can just only be estimated based on the temperature of the water or air.

However, although the temperature of the drum is sensitively changed according to the output of the induction heating system, the change of the temperature of the water or air is slow. Accordingly, there is a problem that the value detected by the heat sensor does not accurately reflect the change of the temperature of the drum.

SUMMARY

The present disclosure has been made in view of the above problems, and provides a washing machine having an induction heater for heating the drum so that the temperature of the drum can be accurately estimated without contacting the drum.

The present disclosure further provides a washing machine which can perform the temperature sensing of the drum by using a thermistor without using expensive equipment such as an infrared sensor, and a control method thereof.

The present disclosure further provides a washing machine that can estimate the temperature of the drum based on the detected values of two temperature sensors that detect the temperature of the air between the drum and the tub when one of the two temperature sensors can accurately estimate the temperature of the drum in consideration of the heat quantity transferred to the entire system due to a heat generation operation when heat is generated by the induction heater, and a control method thereof.

The washing machine of the present disclosure includes a metal drum disposed in the tub and an induction heater for heating the drum while being separated from the drum, and includes a first temperature sensor and a second temperature sensor for detecting the temperature of the drum.

The first temperature sensor and the second temperature sensor detect the temperature of the air between the drum and the tub. The first temperature sensor is heated by the induction heater to generate heat, and the second temperature sensor detects the temperature in a position further away than the first temperature sensor from the induction heater along the circumferential direction.

The temperature of the drum is estimated based on the first detection value of the first temperature sensor and the second detection value of the second temperature sensor, and the controller controls the induction heater based on the estimated temperature of the drum.

In the first temperature sensor, a thermistor is disposed in a metal tube heated by the induction heater. The temperature detected by the thermistor reflects the temperature rise of the tube due to the induction heater.

The tube serves as a heating element for heating the air between the drum and the tub, and affects the detection value of the second temperature sensor. Here, the second temperature sensor is preferably disposed outside the effective heating range of the induction heater.

The detection value of the first temperature sensor and the detection value of the second temperature sensor are obtained, and a temperature equation for obtaining the temperature of the drum can be established from the correlation between the heat value of the induction heater, the heat value of the first temperature sensor, and the heat value of the drum. In the temperature equation, the detection value of the first temperature sensor is a variable, and the detection value of the first temperature sensor is dependent on the output change of the induction heater. Thus, the temperature of the drum is a value sensitive to the output of the induction heater.

In accordance with an aspect of the present disclosure, a washing machine includes: a tub configured to contain water; a drum of metal material configured to be rotated in the tub; an induction heater configured to be fixed to the tub in a state of being separated from the drum, and to heat the drum; a first temperature sensor configured to have a tube of metal material heated by the induction heater and a thermistor disposed in the tube, at least a part of the tube being exposed between the tub and the drum; a second temperature sensor configured to be disposed in a position further away than the first temperature sensor from the induction heater in a circumferential direction, and detect a temperature of air between the tub and the drum; and a controller configured to control the induction heater based on a first detection value of the first temperature sensor and a second detection value of the second temperature sensor.

The controller obtains a temperature of the drum based on a linear combination of the first detection value and the second detection value, and controls the induction heater so that the temperature of the drum is controlled within a preset range. The controller obtains the temperature of the drum by compensating the second detection value based on a difference between the first detection value and the second detection value.

The second temperature sensor is disposed in a position ranging from 55 to 65 degrees from the first temperature sensor with respect to a center of the drum.

The second detection value has a smaller phase than the first detection value.

A cooling water port through which cooling water for condensing moisture in the air in the tub is supplied is provided on a side surface of the tub, and the first temperature sensor and the second temperature sensor are disposed above the cooling water port.

The tube is positioned within an area overlapped with the induction heater, when the induction heater is viewed from above in a vertical direction.

A sensor mounting hole is formed in the tub and the tube passes through the sensor mounting hole, and the first temperature sensor further includes a soft sealer that seals hermetically between the tube and the sensor mounting hole. The sealer has a cylindrical shape extended in a longitudinal direction of the tube and the tube is disposed in a hollow formed inside thereof, and the first temperature sensor further includes a heat insulating cover covering a portion of the tube protruded, through an upper end of the sealer, to the outside of the tub.

The sealer is provided with a fixing groove into which a circumference of the sensor mounting hole is inserted so that the sealer is fixed inside the sensor mounting hole.

In accordance with another aspect of the present disclosure, a washing machine includes: a tub configured to contain water; a drum of metal material configured to be rotated in the tub; an induction heater configured to be fixed to the tub in a state of being separated from the drum, and to heat the drum; first and second temperature sensors configured to have a tube of metal material and a thermistor disposed in the tube; and a controller configured to control the induction heater based on a first detection value of the first temperature sensor and a second detection value of the second temperature sensor, wherein at least a part of the tube of the first temperature sensor is exposed between the tub and the drum, wherein the first temperature sensor is disposed in an effective heating range in which a temperature of the tube of the first temperature sensor is raised by a magnetic flux radiated from the induction heater, wherein the second temperature sensor is disposed further away than the first temperature sensor from the induction heater in a circumferential direction, and is disposed outside the effective heating range.

In accordance with another aspect of the present disclosure, a method of controlling a washing machine including: (a) operating the induction heater; and (b) controlling the induction heater, based on a first detection value of a first temperature sensor having the tube and a second detection value of a second temperature sensor.

The step (b) includes the steps of: obtaining a temperature of the drum based on a linear combination of the first detection value and the second detection value; and controlling the induction heater so that the temperature of the drum is controlled within a preset range.

Obtaining a temperature includes obtaining a temperature of the drum by compensating the second detection value based on a difference between the first detection value and the second detection value.

The second detection value has a smaller phase than the first detection value.

BRIEF DESCRIPTION OF THE DRAWINGS

The objects, features and advantages of the present disclosure will be more apparent from the following detailed description in conjunction with the accompanying drawings, in which.

DETAILED DESCRIPTION

Exemplary embodiments of the present disclosure are described with reference to the accompanying drawings in detail. The same reference numbers are used throughout the drawings to refer to the same or like parts. Detailed descriptions of well-known functions and structures incorporated herein may be omitted to avoid obscuring the subject matter of the present disclosure.

Figure 1:
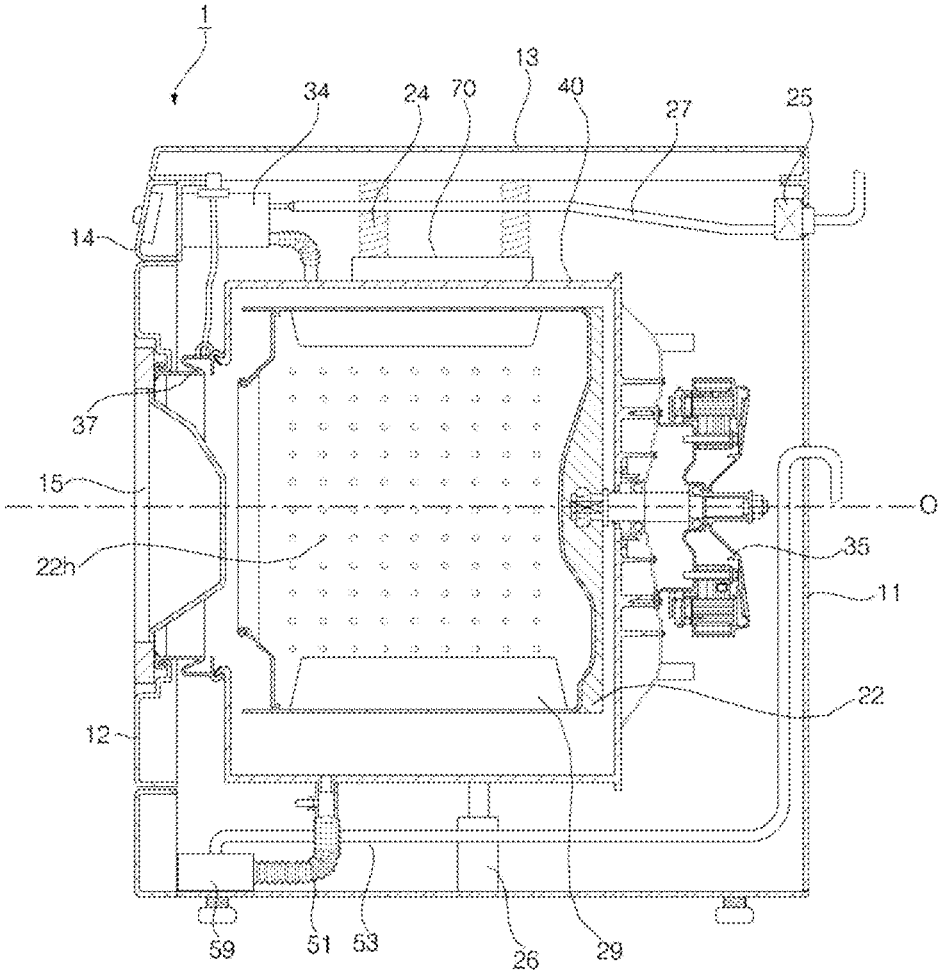
FIG. 1 is a side sectional view of a washing machine according to an embodiment of the present disclosure.
Figure 2:
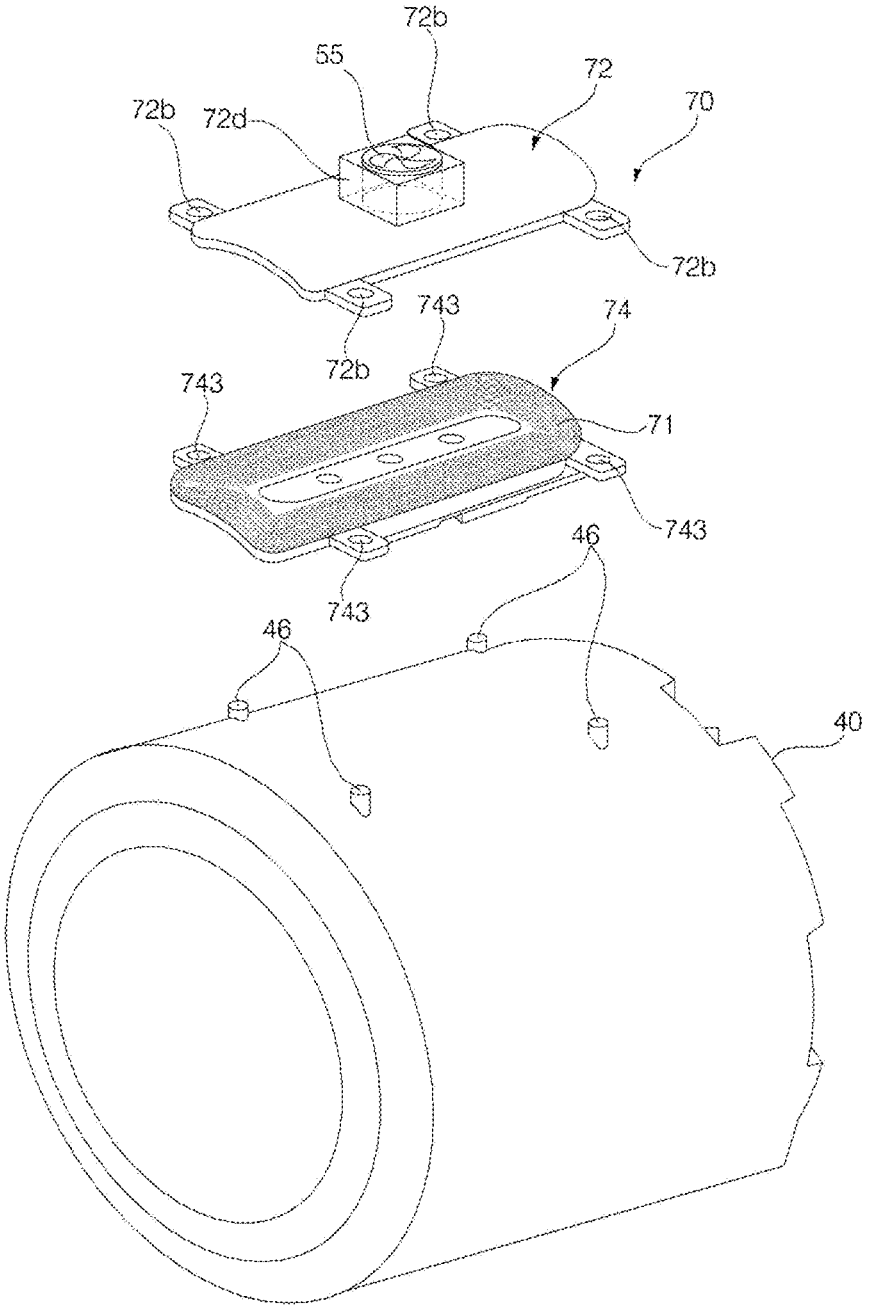
FIG. 2 is an exploded perspective view of a tub and an induction heater.
Figure 3:
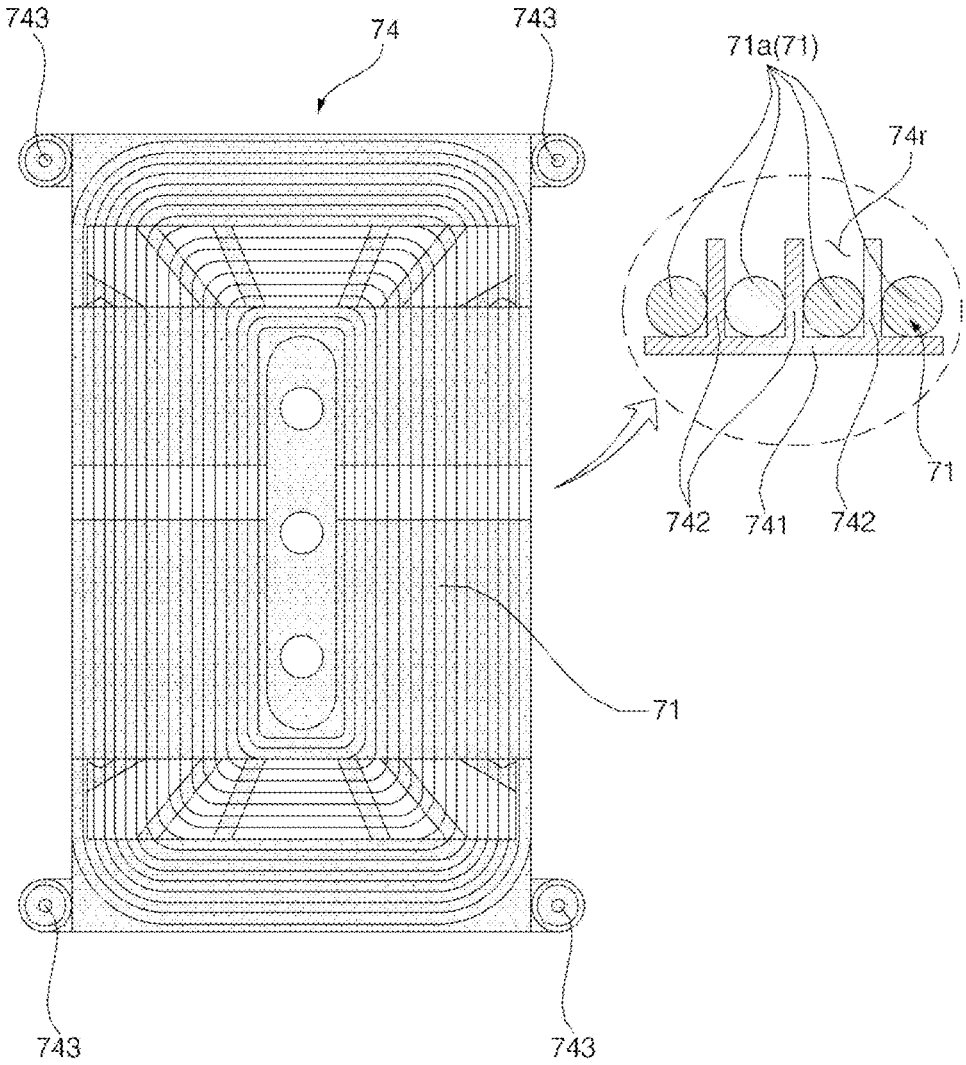
FIG. 3 is a plan view of a heater base shown in FIG. 2.

FIG. 1 is a side sectional view of a washing machine according to an embodiment of the present disclosure. FIG. 2 is an exploded perspective view of a tub and an induction heater. FIG. 3 is a plan view of a heater base shown in FIG. 2.

Referring to FIGS. 1 to 3, a casing 11, 12, 13, 14 forms an outer shape of a washing machine 1 according to an embodiment of the present disclosure, and an input port into which laundry is inputted is formed on the front surface of the washing machine. The casing may include a cabinet 11 which has a front surface opened, a left surface, a right surface, and a rear surface, and a front panel 12 which is coupled to the open front surface of the cabinet 11 and has the input port formed therein. In addition, the casing 11, 12, 13, 14 may further include a top plate 13 covering the opened upper surface of the cabinet 11 and a control panel 14 disposed above the front panel 12.

In the casing 11, 12, 13, 14, a tub 40 for containing water is disposed. The tub 40 has an opening formed on the front surface thereof so as to allow laundry to be inputted, and the opening communicates with the input port formed in the front panel 12 by a gasket 37.

The front panel 12 is rotatably provided with a door 15 for opening and closing the input port. The control panel 14 is provided with a display unit (not shown) for displaying various state information of the washing machine 1 and an input unit (not shown) for receiving various control commands such as a washing course, operating time for each process, reservation from a user.

A dispenser 34 for supplying an additive such as laundry detergent, fabric softener, or bleaching agent to the tub 40 is provided. The dispenser 34 includes a detergent box in which the additive is contained, and a dispenser housing in which the detergent box is removably stored. A water supply hose 27 connected to an external water source such as a faucet to receive raw water, and a water supply valve 25 for interrupting the water supply hose 27 may be provided. When the water supply valve 25 is opened and water is supplied through the water supply hose 27, the detergent in the detergent box is mixed with water and flows into the tub 40.

The tub 40 may be suspended from the top plate 13 by a spring 24, and may be supported by a damper 26 disposed in a lower side. Therefore, the vibration of the tub 40 is buffered by the spring 24 and the damper 26.

A drum 22 is rotatably disposed in the tub 40. The drum 22 may be implemented of a material (or a material whose current is induced by a magnetic field (or a magnetic force) or a ferromagnetic body) heated in a non-contact type by a later-described induction heater 70. Preferably, the drum 22 may be implemented of metal material, e.g., stainless steel. A plurality of through holes 22*h* may be formed in the drum 22 so that water can be exchanged between the tub 40 and the drum 22.

The washing machine according to the present embodiment is a front loading type in which the drum 22 is rotated about a horizontal axis O. However, the present disclosure is also applicable to a washing machine of a top loading type. In this case, a drum rotated about a vertical axis is provided.

The drum 22 is rotated by a driving unit 35, and a lifter 29 is provided inside the drum 22 so as to lift laundry. The driving unit 35 may include a motor capable of controlling a rotation direction and a speed. The motor is preferably a brushless direct current electric motor (BLDC), but it is not necessarily limited thereto.

A drainage bellows 51 for discharging the water in the tub 40 to the outside, and a pump 59 for pumping the water discharged through the drainage bellows 51 to a drainage hose 53 may be provided. The water pumped by the pump 59 is discharged to the outside of the washing machine through the drainage hose 53.

An induction heater 70 for heating the drum 22 is provided. The induction heater 70 is a heater that uses an induction current generated by a magnetic field as a heat source. When a metal is placed in a magnetic field, an eddy current is generated in the metal due to electromagnetic induction and the metal is heated due to Joule heat.

The induction heater 70 is fixed to the tub 40 while being spaced apart from the drum 22. When the induction heater 70 is operated, the drum 22 of metal material is heated. The tub 40 is implemented of a material (preferably, synthetic resin) through which a magnetic field can pass, and the induction heater 70 is disposed outside the tub 40. However, it is not limited thereto, and the induction heater 70 can be disposed inside the tub 40.

The induction heater 70 may include a coil 71 to which a current is applied, a heater base 74 that fixes the coil 71, and a heater cover 72 which is coupled to the heater base 74 and covers the coil 71 from the upper side of the coil 71.

The heater base 74 may be fixed to the tub 40. The heater base 74 may be disposed in the outer side of the tub 40, preferably, in the upper side of the tub 40. The heater base 74 has a first coupling tab 743 provided with a fastening hole. Four first coupling tabs 743 may be symmetrically disposed. A fastening boss 46 is formed, in the tub 40, at a position corresponding to the first coupling tab 743. The heater base 74 has a substantially flat shape, but preferably has a shape substantially corresponding to the curvature of the outer circumferential surface of the tub 40. The heater base 74 is implemented of a material through which a magnetic field can pass, and is preferably a synthetic resin material.

The coil 71 is fixed to the upper surface of the heater base 74. In an embodiment, the coil 71 is formed by winding a single conducting wire 71*a* several times based on homocentricity on the upper surface of the heater base 74, but may be formed of a plurality of conducting wires in the form of a closed curve having homocentricity according to an embodiment.

A fixing rib 742 for fixing the coil 71 is protruded from an upper surface 741 of the heater base 74. The fixing rib 742 is wound while maintaining a gap 74*r* corresponding to the diameter of the conducting wire 71*a* forming the coil 71. The coil 71 may be formed by winding the conducting wire 71*a* along the gap 74*r*.

The heater cover 72 may be provided with a ferromagnetic body. The ferromagnetic body may include ferrite. The ferromagnetic body may be fixed to the bottom surface of the heater cover 72. Since the high resistance of the ferrite prevents the generation of eddy current, a current is intensively induced in the drum 22 positioned in the lower side of the coil 71, so that the drum 22 can be effectively heated.

The heater cover 72 may be provided with a cooling fan 55 for cooling the coil 71. The heater cover 72 may be provided with a fan mount 72*d* that forms an air passage for ventilating a space in which the coil 71 is accommodated. The cooling fan 55 may be disposed in the air passage.

The heater cover 72 is provided with a second coupling tab 72*b* having a fastening hole at a position corresponding to the first coupling tab 743 of the heater base 74. A screw (not shown) may pass through the second coupling tab 72*b* and the first coupling tab 743 sequentially, and then be fastened to the fastening boss 46.

Meanwhile, in order to process the laundry in the drum 22 at a desired temperature, the temperature of the drum 22 should be accurately controlled. The temperature of the drum 22 is greatly affected by the output of the induction heater 70. The amount of the laundry inputted in the drum 22, the amount of water contained in the tub 40, the rotation speed of the drum 22, and the amount of water contained in the laundry are affected by various factors. Therefore, it is difficult to obtain an accurate value when estimating the temperature of the drum 22 by only the output (or input) of the induction heater 70.

Furthermore, it is assumed that the processes such as washing, rinsing, dewatering, drying, are usually performed by rotating the drum 22. Thus, it is difficult to use a contact type temperature sensor to measure the temperature of the rotating drum 22.

For these reasons, the present disclosure includes two temperature sensors 80*a* and 80*b* configured to detect the temperatures of air of two points between the drum 22 and the tub 40, and the temperature of the drum 22 is estimated based on the values detected by these temperature sensors 80*a* and 80*b*.

Since this method measures the temperature of the air and estimates the temperature of the drum 22 based on the temperature of the air, it does not directly measure the temperature of the drum 22. However, by using the value detected by two temperature sensors 80*a* and 80*b*, it is possible to estimate the temperature of the drum 22 more accurately and to detect the temperature change of the drum 22 more sensitively than in the conventional case where the temperature is sensed through a single temperature sensor.

Figure 4:
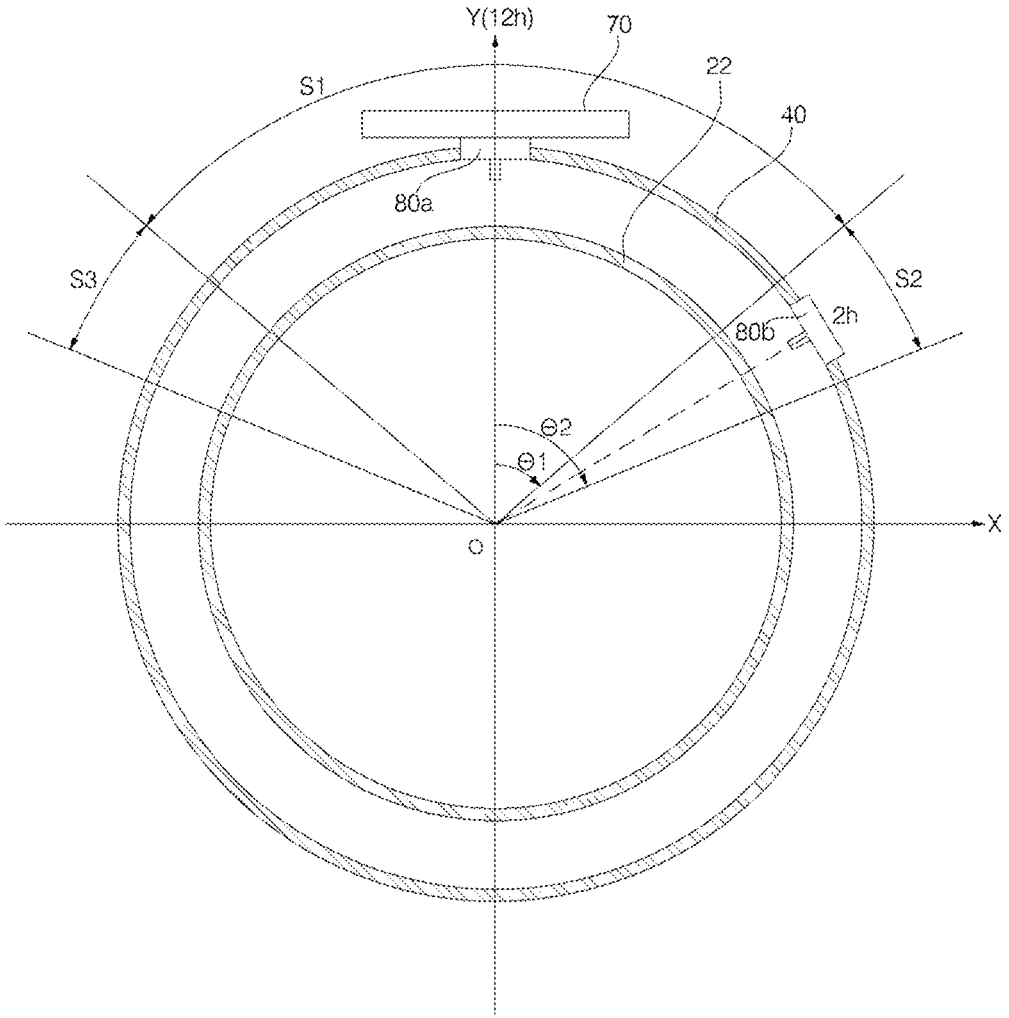
FIG. 4 schematically shows a position where a first temperature sensor and a second temperature sensor are installed.
Figure 5B:
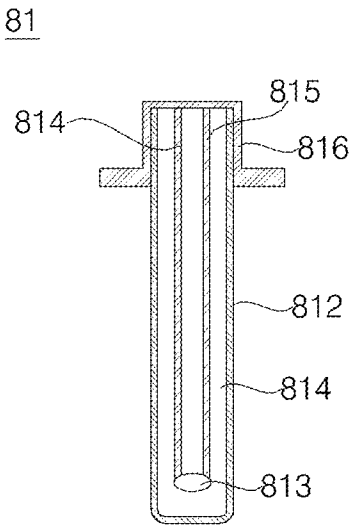
FIG. 5B shows a cross section of a thermistor.
Figure 5A:
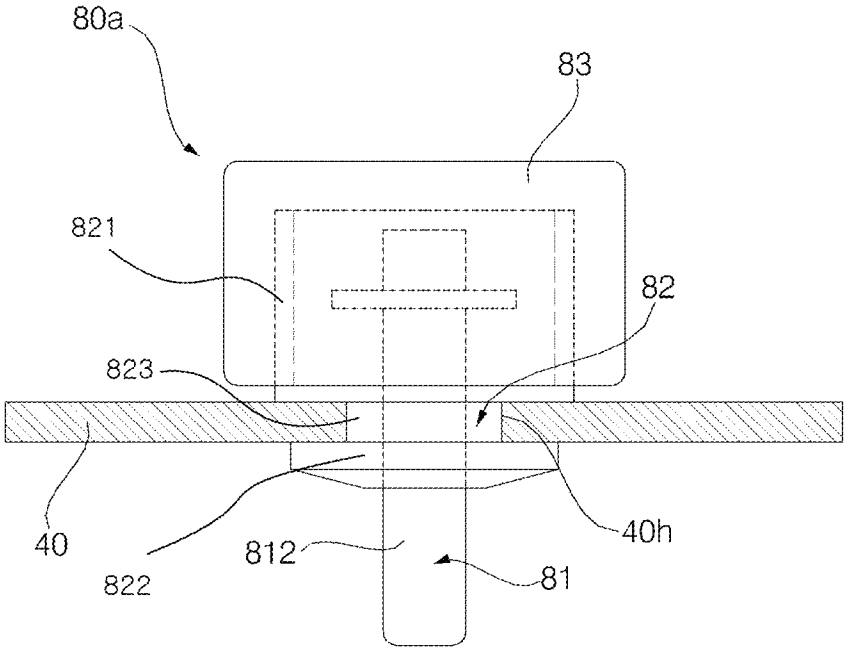
FIG. 5A shows a state where a first temperature sensor is installed in a tub.
Figure 6:
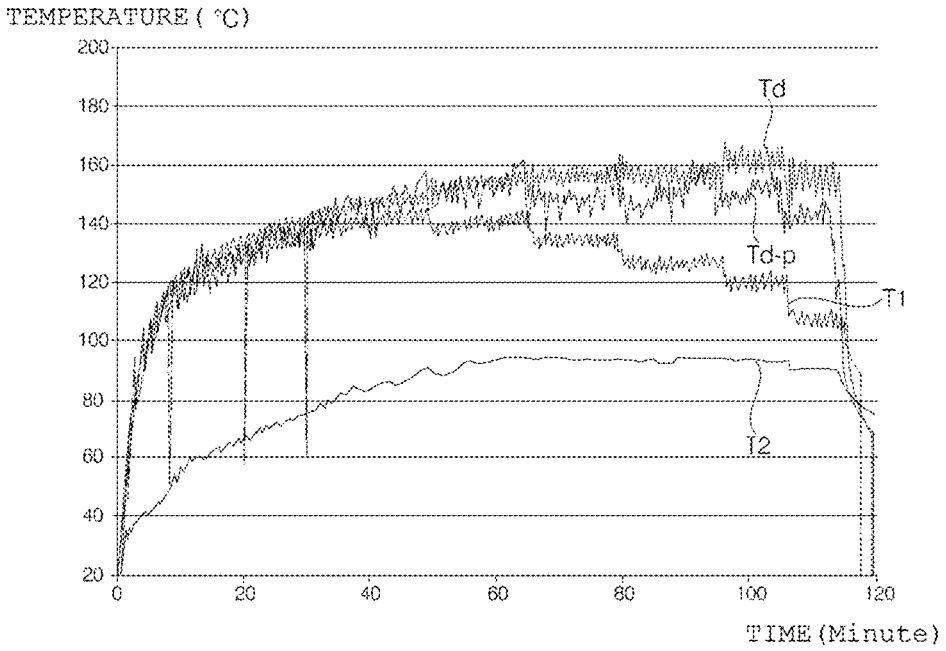
FIG. 6 is a graph showing the changes over time of the actual temperature Td_p of a drum, the detection value T1 of a first temperature sensor, the detection value T2 of a second temperature sensor, and the estimated value Td of drum temperature, when an induction heater is controlled in a certain pattern.
Figure 7:
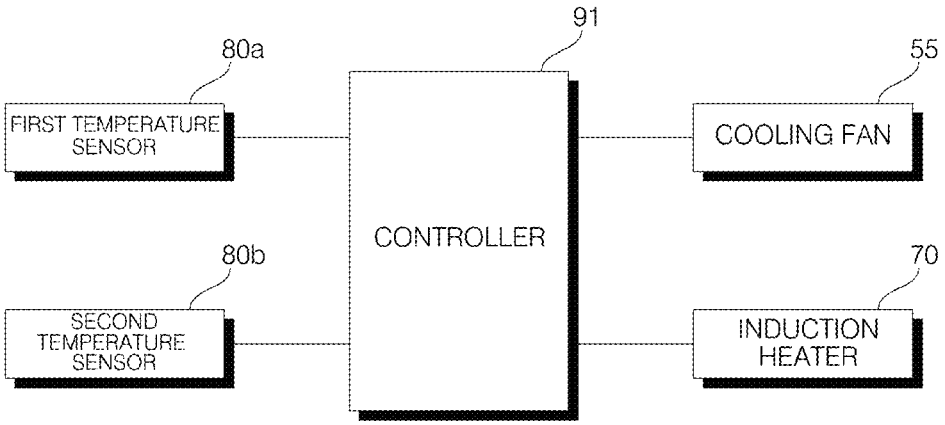
FIG. 7 is a block diagram showing a control relationship between main components of a washing machine according to an embodiment of the present disclosure.
Figure 8:
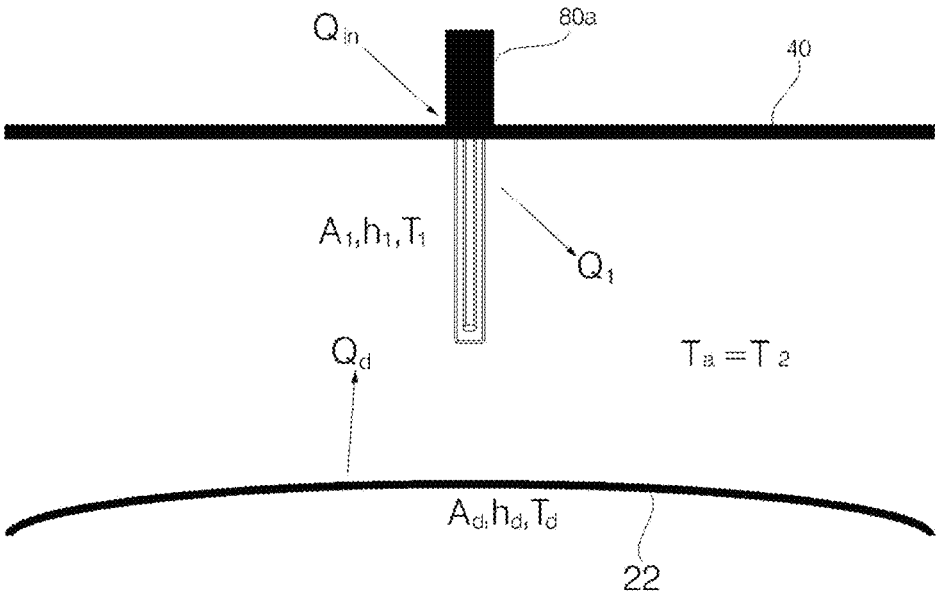
FIG. 8 shows the heat quantity transferred between an induction heater, a drum, and a first temperature sensor, which are referred to in the process of obtaining the estimated value of drum temperature.

FIG. 4 schematically shows a position where a first temperature sensor and a second temperature sensor are installed. FIG. 5A shows a state where a first temperature sensor is installed in a tub, and FIG. 5B shows a cross section of a thermistor. FIG. 6 is a graph showing the changes over time of the actual temperature Td_p of a drum, the detection value T1 of a first temperature sensor, the detection value T2 of a second temperature sensor, and the estimated value Td of drum temperature, when the induction heater is controlled in a certain pattern. FIG. 7 is a block diagram showing a control relationship between main components of a washing machine according to an embodiment of the present disclosure. FIG. 8 shows the heat quantity transferred between an induction heater, a drum, and a first temperature sensor, which are referred to in the process of obtaining the estimated value of drum temperature.

Referring to FIGS. 4 to 8, two temperature sensors 80*a* and 80*b* include a first temperature sensor 80*a* and a second temperature sensor 80*b*. The first temperature sensor 80*a* itself is heated by the induction heater 70, and the temperature detected by the first temperature sensor 80*a* under the normal operating condition of the washing machine is higher than the temperature Ta of the air in the tub 40. That is, in a state of being heated by the induction heater 70, the first temperature sensor 80*a* is a heating element that transmits heat to the air in the tub 40, and the heat quantity transmitted to the air at this time is indicated by Q1 in FIG. 8.

Referring to FIG. 5, the first temperature sensor 80*a* may include a thermistor assembly 81 and a heat insulating cover 83. The thermistor assembly 81 may include a tube 812 made of a material (preferably, metal) that is heated by the induction heater 70, and a thermistor 813 disposed in the tube 812. Here, at least a part of the outer surface of the tube 812 is exposed between the tub 40 and the drum 22 to sense the temperature of the air. The tube 812 is heated by the induction heater 70 while an induction current flows through the metal so that the temperature of the tube 812 is reflected in the temperature obtained through the thermistor 813 disposed in the tube 812.

The upper end of the tube 812 is open so that the thermistor 813 can be inserted into the tube 812. Two lead wires 814 and 815 for inputting and outputting a current are connected to the thermistor 813 and a filler for fixing the thermistor 813 and the lead wires 814 and 815 is filled in the tube 812. The filler is made of a material that transmits heat but does not conduct electricity.

The open upper end of the tube 812 is closed by a cap 816. The cap 816 is provided with a pair of terminals connected to two lead wires 814 and 815 respectively, and is connected to a certain circuit electrically connected to a controller 91.

A sensor mounting hole 40*h* is formed in the tub 40, and the tube 812 passes through the sensor mounting hole 40*h*. The first temperature sensor 80*a* may include a soft sealer 82 that seals hermetically between the tube 812 and the sensor mounting hole 40*h*. The sealer 82 has a cylindrical shape extended in the longitudinal direction of the tube 812, and the tube 812 is disposed inside the sealer 82. The tube 812 passes through a hollow formed in the sealer 82. The sealer 82 may include an upper side portion 821 located outside the tub 40, a lower side portion 822 located inside the tub 40, and a connection portion 823 which connects the upper side portion 821 and the lower side portion 822 and is inserted into the sensor mounting hole 40*h*. The lower surface of the upper side portion 821 may be brought into close contact with the outer surface of the tub 40, and the upper surface of the lower surface portion 822 may be brought into close contact with the inner surface of the tub 40.

The upper surface of the upper side portion 821 may be opened to form a recessed space inside thereof. The hollow through which the tube 81 passes may pass the upper side portion 821, the connection portion 823, and the lower side portion 822 sequentially.

The connection portion 823 may have a radius smaller than the upper side portion 821 and the lower side portion 822. The circumference of the sensor mounting hole 40*h* of the tub 40 may be inserted into a fixing groove 82*r* formed by a radial difference between the upper side portion 821 and the upper end of the connection portion 823 and a radial difference between the lower side portion 822 and the lower end of the connection portion 823.

Meanwhile, the heat insulating cover 83 covers the portion of the first temperature sensor 80*a* protruded to the outside of the tub 40. The heat insulating cover 83 may close the open upper surface of the upper side portion 821 of the sealer 82. The heat insulating cover 83 is made of a material (e.g., synthetic resin or rubber) having good heat insulation property. Since the inside of the sealer 82 is insulated to a certain degree by the heat insulating cover 83, the influence of the temperature outside the tub 40 on the detection value of the first temperature sensor 80*a* is reduced.

Similarly to the first temperature sensor 80*a*, the second temperature sensor 80*b* detects the temperature of the air between the tub 40 and the drum 22, but is disposed in a position further away from the induction heater 70 than the first temperature sensor 80*a* along the circumferential direction.

Here, the second temperature sensor 80*b* is preferably configured not to be affected by the induction heater 70. For example, the second temperature sensor 80*b* may be configured of a sensor that is not affected by the magnetic field generated by the induction heater 70. For example, the second temperature sensor 80*b* may be configured with the exception of the metal part (e.g., tube 812) that is heated by the induction heater 70. However, in this case, since the second temperature sensor 80*b* should be configured differently from the first temperature sensor 80*a*, the commonality of parts is low. Thus, it is preferable to dispose the second temperature sensor 80*b* in a position where the influence of the induction heater 70 is substantially insufficient, while the second temperature sensor 80*b* has the same structure as the first temperature sensor 80*a*.

Referring to FIG. 4, the second temperature sensor 80*b* may be disposed in a position of 55 degrees to 65 degrees from the first temperature sensor 80*a* with respect to the center O of the drum 22. This section may be provided in both sides of the Y axis passing through the center of the drum 22, and this section is indicated by S2($\theta1=55°$, $\theta2=65°$) and S3 in FIG. 4.

In FIG. 4, S1 indicates an effective heating range in which the first temperature sensor 80*a* is disposed. The effective heating range S1 may include an area vertically downward from the induction heater 70.

The tube 81 of the first temperature sensor 80*a* is positioned below the induction heater 70, and is preferably positioned in an area overlapped with the induction heater 70 when viewed from the top in a vertical direction. The first temperature sensor 80*a* is preferably positioned at 12 o'clock (12*h*) with reference to FIG. 4, but is not necessarily limited thereto.

Meanwhile, on a side surface of the tub 40, a cooling water port (not shown) may be provided to supply cooling water for condensing moisture in the air in the tub 40. It is preferable that the first temperature sensor 80*a* and the second temperature sensor 80*b* are disposed above the cooling water port so that the influence of the condensed water is excluded when temperature is detected.

The controller 91 may control the induction heater 70 based on a first detection value T1 of the first temperature sensor 80*a* and the second detection value T2 of the second temperature sensor 80*b*. Specifically, the controller 91 may obtain the temperature Td of the drum 22 based on the linear combination of the first detection value T1, and may control the induction heater 70 so that the temperature Td of the drum 22 is controlled within a preset range.

The controller 91 may obtain the temperature Td of the drum 22 based on the first detection value T1 and the second detection value T2, and may control the output of the induction heater 70 or the operation of the cooling fan 55 based on the obtained temperature Td (exactly, an estimated value of the actual temperature of the drum 22 (see FIG. 6)) of the drum 22. Hereinafter, a method of obtaining the temperature Td of the drum 22 will be described in more detail.

The temperature Td of the drum 22 may be obtained according to the following temperature equation (Equation 1) obtained by linearly combining the first detection value T1 and the second detection value T2. The controller 91 may control the induction heater 70 so that the temperature Td of the drum 22 is controlled within a preset range, based on the obtained temperature Td.

$$Td=Z(T1-T2)+T2 \quad \text{(Equation 1)}$$

Here, Td=temperature of the drum, Z=correction coefficient, T1=first detection value, T2=second detection value.

The process of obtaining the above equations is explained in more detail.

The drum 22 and the first temperature sensor 80*a* heated by the induction heater 70 generate heat so that the temperature Ta of the air in the tub 40 is increased, which is expressed as follows.

$$Qin=Qd+Q1 \quad \text{(Equation 2)}$$

$$Q1=A1h1(T1-Ta) \quad \text{(Equation 3)}$$

$$Qd=Adhd(Td-Ta) \quad \text{(Equation 4)}$$

Qin is the heat quantity outputted from the induction heater 70, Qd is the heat value of the drum 22 heated by the induction heater 70, Q1 is the heat value of the first temperature sensor 80*a* heated by the induction heater 70, Ta is the temperature of the air between the tub 40 and the drum 22, A1 is the heat generating area of the first temperature sensor 80*a*, Ad is the heat generating area of the drum 22, h1 is the heat transfer coefficient of the first temperature sensor 80*a*, and hd is the heat transfer coefficient of the drum 22.

It is assumed that the drum 22 has a uniform temperature Td, the temperature Ta of the air in the tub 40 is also uniform, and the second temperature sensor 80*b* is not influenced by the induction heater 70.

$$Qin=(Td-Ta)+A1h1(T1-Ta) \quad \text{(Equation 5)}$$

Here, the shape coefficient p and the heat value coefficient q are defined as follows, $$p=A1h1/Adhd \quad \text{(Equation 6)}$$

$$q=Q1/Qd \quad \text{(Equation 7)}$$

Equation 5 is summarized using Equation 6 as follows.

$$Td=QinAdhd+(1+p)Ta-pT1 \quad \text{(Equation 8)}$$

Here, the following equations may be obtained by using Equation 2 and Equation 4 to summarize.

$$Td=(Qd+Q1Qd)/Qd(Td-Ta)+(1+p)T-pT1 \quad \text{(Equation 9)}$$

The following equation may be obtained by substituting Equation 7 into Equation 9.

$$Td=(1+q)(Td-Ta)+(1+p)Ta-pT1 \quad \text{(Equation 10)}$$

Equation 9 may be summarized by using the shape coefficient p and the heat value coefficient q, and the correction coefficient Z may be defined as follows.

$$Z=p/q=(Td-Ta)/(T1-Ta) \quad \text{(Equation 11)}$$

$$Td=Z(T1-Ta)+Ta \quad \text{(Equation 12)}$$

Here, since Ta is a value obtained by the second temperature sensor 80*b*, Ta=T2, and Equation 12 becomes the same as the temperature equation of Equation 1. In this process, the second detection value T2 obtained by the second temperature sensor 80*b* is compensated by a difference between the first detection value T1 obtained by the first temperature sensor 80*a* and the second detection value T2, so that the temperature Td of the drum 22 can be obtained.

Meanwhile, in Equation 11, the correction coefficient Z is obtained by taking the shape coefficient p and the heat value coefficient q as factors. The shape coefficient p is a coefficient whose value is determined according to the shape of the first temperature sensor 80*a* and the drum 22, and the heat value coefficient q is a variable determined by the output (input from the viewpoint of control) of the induction heater 70 and the quantity of state.

Therefore, Z can be expressed as follows.

$$Z=ZconstZpower \quad \text{(Equation 13)}$$

Here, Zconst is a constant, and Zpower is a variable according to the input of the induction heater 70.

As shown in the temperature equation (Equation 1), if the detection value T1 of the first temperature sensor 80*a* and the detection value T2 of the second temperature sensor 80*b* are known, the estimated value Td of the temperature of the drum 22 may be approximated to the current temperature Td_p of the drum 22 by appropriately setting the Zpower value. In particular, in the temperature equation (Equation 1), the first term of the right side is a value used to compensate so that the second detection value T2 of the second temperature sensor 80*b* follows the actual temperature of the drum 22, and is influenced by the Z value. Here, Z is a value that varies depending on the variable Zpower. If Zpower is properly set, the estimated value Td approximating the actual temperature Td_p of the drum 22 may be obtained. The Zpower value according to the input of the induction heater 70 may be previously set through an experiment that the estimated value Td of the drum 22 obtained while varying the input of the induction heater 70 follows the actual temperature Td_p of the drum 22.

Meanwhile, in FIG. 6, the input of the induction heater 70 is gradually decreased so that the actual temperature Td_p of the drum 22 does not exceed about 160 degrees centigrade.

Here, examining a section (i.e., a section in which the detection value of the first temperature sensor 80*a* is gradually decreased) in which the input of the induction heater 70 is gradually decreased, the actual temperature Td_p of the drum 22 is maintained within a certain range even though the output (input) of the induction heater 70 is reduced. However, the first detection value T1 of the first temperature sensor 80*a* is gradually decreased and the second detection value T2 of the second temperature sensor 80*b* does not vary greatly. Accordingly, it can be seen that the difference between the first detection value T1 and the second detection value T2 is gradually reduced.

This means that the value of (T1−T2) is decreased in the first term (i.e., the term compensating T2 so that the estimated value Td of the temperature of the drum 22 may be approximated to the actual temperature Td_p of the drum 22) in the left side of the temperature equation (Equation 1). Therefore, in order for the estimated value Td of the temperature of the drum 22 in the temperature equation to approximate the actual temperature Td_p of the drum, Z should be increased. That is, by compensating T2 by setting Zpower inversely proportional to (T1−T2) (or by setting inversely proportional to the input of the induction heater 70), the estimated value Td of a value approximate to the actual temperature Td_p of the drum 22 can be finally obtained.

Meanwhile, as shown in the temperature equation (Equation 1), the temperature Td of the drum takes T1 as a variable. Since T1 is a value which is changed sensitively to the output of the induction heater 70, the temperature Td of the drum 22 obtained by the temperature equation reflects the output change of the induction heater 70. This means that the variation of the temperature of the drum 22 due to the output change of the induction heater 70 can be detected quickly.

Particularly, when the output of the induction heater 70 is changed, the temperature change of the air in the tub 40 is accomplished slower than the temperature change of the drum 22. Therefore, in the conventional method of detecting the temperature of the air by using only a single temperature sensor, the temperature change of the drum 22 due to the output change of the induction heater 70 cannot be detected sensitively. However, in the case of the present disclosure, since the heat value Q1 of the first temperature sensor 80*a* that sensitively reflects the output of the induction heater 70 is considered in the process of obtaining the temperature Td of the drum 22. Accordingly, the change in the temperature of the drum 22 can be detected more sensitively and quickly than in the conventional method.

Meanwhile, when the second temperature sensor 80*b* is also heated by the induction heater 70 like the first temperature sensor 80*a* (e.g., when the second temperature sensor 80*b* has the same structure as the first temperature sensor 80*a*), the first temperature sensor 80*a* is disposed within an effective heating range (See S1 in FIG. 4) in which the temperature of the tube 812 of the first temperature sensor 80*a* is raised by the magnetic flux (or a magnetic field generated by the induction heater 70) radiated from the induction heater 70, and the second temperature sensor 80*b* is disposed outside the effective heating range (see S2 and S3 in FIG. 4).

Here, the effective heating range is set such that, when the output of the induction heater 70 is changed, a temperature change of the first temperature sensor 80*a* positioned within the effective heating range has a phase (i.e., a large phase) that precedes the second temperature sensor 80*b* positioned outside the effective heating range. For example, when the output of the induction heater 70 is raised, the temperature of the first temperature sensor 80*a* positioned within the effective heating range first rises to a peak due to the influence of the induction heater 70, and the temperature of the second temperature sensor 80*b* positioned outside the effective heating range reaches the peak only after the heat is transferred to the air from the drum 22 and the first temperature sensor 80*a* which are heating element. Thus, the temperature T2 detected by the second temperature sensor 80*b* has a smaller phase value than the temperature T1 detected by the first temperature sensor 80*a* (i.e., the variation of T2 follows the variation of T1).

Meanwhile, according to an embodiment, even when the second temperature sensor 80*b* is implemented of a sensor which is not influenced by the induction heater 70 and disposed in the effective heating range S1, the second temperature sensor 80*b* is preferably disposed in a position further away than the first temperature sensor 80*a* from the induction heater 70 in the circumferential direction.

The present disclosure compensates the measured temperature T2 of the air by using the correction values Z(T1−T2) obtained based on two temperature sensors 80*a* and 80*b* and obtains the estimated value Td which approximates to the actual temperature of the drum 22. Therefore, a deviation of more than a certain level should exists between the first detection value T1 detected by the first temperature sensor 80*a* and the second detection value T2 detected by the second temperature sensor 80*b*. For this reason, even if the second temperature sensor 80*b* is not influenced by the induction heater 70, it is preferable that the second temperature sensor 80*b* is configured to detect the temperature of an area spaced by a certain distance from the first temperature sensor 80*a* in the circumferential direction instead of detecting the temperature of the circumference of the first temperature sensor 80*a*.

Preferably, the second temperature sensor 80*b* is spaced farther away than the first temperature sensor 80*a* from the induction heater 70 in the direction of rotation of the drum 22. Since the drum 22 is cooled during the rotation of a portion heated by the induction heater 70, the heated portion is cooled when reaching a position corresponding to the second temperature sensor 80*b*, so that the detection value T2 of the second temperature sensor 80*b* can be distinguished from the detection value T1 of the first temperature sensor 80*a*.

As described above, the washing machine and the control method according to the present disclosure have effects as follows. First, in the washing machine provided with the induction heater for heating the drum, the temperature of the drum can be estimated more accurately than the conventional method of estimating the temperature of the drum by using a single temperature sensor.

Second, since the temperature detection of the drum is performed by using a thermistor instead of using expensive equipment such as an infrared sensor, the manufacturing cost can be reduced.

Third, since the output (or input) of the induction heater is considered in the process of obtaining the temperature of the drum, the temperature change of the drum due to the output change of the induction heater can be sensitively detected.

Although the exemplary embodiments of the present disclosure have been disclosed for illustrative purposes, those skilled in the art will appreciate that various modifications, additions and substitutions are possible, without departing from the scope and spirit of the disclosure as disclosed in the accompanying claims. Accordingly, the scope of the present disclosure is not construed as being limited to the described embodiments but is defined by the appended claims as well as equivalents thereto.

What is claimed is:

1. A washing machine comprising:

a tub configured to contain water;

a drum of metal material configured to be rotated in the tub;

an induction heater fixed to the tub in a state of being separated from the drum, and configured to heat the drum;

a first temperature sensor having a tube of metal material and configured to obtain a temperature reflecting a temperature of the tube heated by the induction heater;

a second temperature sensor configured to detect a temperature of air between the tub and the drum; and a controller configured to control the induction heater based on a first detection value of the first temperature sensor and a second detection value of the second temperature sensor.

2. The washing machine of claim 1, wherein the controller is configured to obtain a temperature of the drum based on a linear combination of the first detection value and the second detection value, and to control the induction heater so that the temperature of the drum is controlled within a preset range.

3. The washing machine of claim 2, wherein the controller is configured to obtain the temperature of the drum by compensating the second detection value based on a difference between the first detection value and the second detection value.

4. The washing machine of claim 1, wherein the second temperature sensor is disposed in a position further away than the first temperature sensor from the induction heater in a circumferential direction of the tub.

5. The washing machine of claim 1, wherein the first temperature sensor further comprises a thermistor disposed in the tube and the thermistor obtains the temperature reflecting the temperature of the tube and wherein at least a part of the tube is exposed between the tub and the drum.

6. The washing machine of claim 1, wherein a cooling water port through which cooling water is supplied is provided on a side surface of the tub, wherein the first temperature sensor and the second temperature sensor are disposed above the cooling water port.

7. The washing machine of claim 1, wherein the first temperature sensor is disposed in an effective heating range in which a temperature of the tube of the first temperature sensor is raised by a magnetic flux radiated from the induction heater; and wherein the second temperature sensor is disposed outside the effective heating range.

8. The washing machine of claim 1, wherein the tube is positioned within an area overlapped with the induction heater, when the induction heater is viewed from above in a vertical direction.

9. The washing machine of claim 1, wherein a sensor mounting hole is formed in the tub and the tube passes through the sensor mounting hole, wherein the first temperature sensor further comprises a soft sealer that seals hermetically between the tube and the sensor mounting hole.

10. The washing machine of claim 9, wherein the sealer has a cylindrical shape extended in a longitudinal direction of the tube and the tube is disposed in a hollow formed inside thereof.

11. The washing machine of claim 9, wherein the sealer is provided with a fixing groove into which a circumference of the sensor mounting hole is inserted so that the sealer is fixed inside the sensor mounting hole.

12. The washing machine of claim 1, wherein the first temperature sensor further comprises a heat insulating cover covering a portion of the tube protruded, through an upper end of a sealer, to an outside of the tub.

13. A method of controlling a washing machine comprising a tub, a drum of metal material which is rotatably disposed in the tub, an induction heater which is fixed to the tub in a state of being separated from the drum and heats the drum, a first temperature sensor having a tube of metal material heated by the induction heater and exposed between the tub and the drum partially, and a second temperature sensor, the method comprising the steps of:

(a) operating the induction heater;

(b) detecting a first detection value which is a temperature of the tube using the first temperature sensor;

(c) detecting a second detection value which is a temperature of air between the tub and the drum using the second temperature sensor; and (d) controlling the induction heater based on the first detection value and the second detection value.

14. The method of claim 13, wherein the step (d) comprises the steps of:

obtaining a temperature of the drum based on a linear combination of the first detection value and the second detection value; and controlling the induction heater so that the temperature of the drum is controlled within a preset range.

15. The method of claim 13, wherein obtaining the temperature of the drum comprises obtaining the temperature of the drum by compensating the second detection value based on a difference between the first detection value and the second detection value.

16. The method of claim 13, wherein the first temperature sensor is disposed in an effective heating range in which the temperature of the tube is raised by a magnetic flux radiated from the induction heater; and wherein the second temperature sensor is disposed outside the effective heating range.

* * * * *